US009893422B2

(12) United States Patent
Chou

(10) Patent No.: US 9,893,422 B2
(45) Date of Patent: Feb. 13, 2018

(54) ANTENNA WITH THE EIGHTH OF THE WAVELENGTH

(71) Applicant: WISTRON CORP., New Taipei (TW)

(72) Inventor: Chen-Yu Chou, New Taipei (TW)

(73) Assignee: WISTRON CORP., New Taipei (TW)

( * ) Notice: Subject to any disclaimer, the term of this patent is extended or adjusted under 35 U.S.C. 154(b) by 104 days.

(21) Appl. No.: 14/217,492

(22) Filed: Mar. 18, 2014

(65) Prior Publication Data

US 2015/0097750 A1 Apr. 9, 2015

(30) Foreign Application Priority Data

Oct. 9, 2013 (TW) ..... 102136603 A

(51) Int. Cl.

| | |
|---|---|
| ***H01Q 9/04*** | (2006.01) |
| ***H01Q 5/371*** | (2015.01) |
| ***H01Q 1/22*** | (2006.01) |
| ***H01Q 1/48*** | (2006.01) |
| ***H01Q 9/42*** | (2006.01) |

(52) U.S. Cl.

CPC ..... *H01Q 5/371* (2015.01); *H01Q 1/22* (2013.01); *H01Q 1/48* (2013.01); *H01Q 9/42* (2013.01)

(58) Field of Classification Search

CPC ..... H01Q 5/371; H01Q 9/42

USPC ..... 343/700 MS, 702, 843, 848

See application file for complete search history.

(56) References Cited

U.S. PATENT DOCUMENTS

| | | | | |
|---|---|---|---|---|
| 5,191,352 A * | 3/1993 | Branson | ..... | H01Q 1/362 343/850 |
| 6,603,432 B2 * | 8/2003 | Hill | ..... | H01Q 1/243 343/700 MS |
| 7,764,236 B2 * | 7/2010 | Hill | ..... | H01Q 1/243 343/702 |

(Continued)

FOREIGN PATENT DOCUMENTS

| | | |
|---|---|---|
| CN | 1394370 A | 1/2003 |
| TW | I396330 B1 | 5/2013 |

OTHER PUBLICATIONS

The office action of the corresponding Chinese application dated Oct. 31, 2016 and its partial English translation.

*Primary Examiner* — Dameon E Levi
*Assistant Examiner* — Ab Salam Alkassim, Jr.
(74) *Attorney, Agent, or Firm* — CKC & Partners Co., Ltd.

(57) ABSTRACT

An antenna includes a grounding conductor, a feed conductor, a resonant conductor, and a radioactive conductor. The feed conductor is disposed apart from the grounding conductor. The resonant conductor having a resonant width is disposed along the grounding conductor and disposed apart from the grounding conductor by a resonant-ground distance. The resonant conductor connects to the feed conductor. The radioactive conductor has a radioactive width. One end of the radioactive conductor connects to one end of the resonant conductor with the feed conductor, and another end of the radioactive conductor is disposed apart from the grounding conductor. The radioactive conductor is disposed along the resonant conductor and disposed apart from the resonant conductor by a resonant-radioactive distance. The resonant conductor is positioned between the radioactive conductor and the grounding conductor. A proportion of the resonant-ground distance, the resonant width, the resonant- (Continued)

radioactive distance, and the radioactive width is a fixed proportion.

12 Claims, 9 Drawing Sheets

(56) References Cited

U.S. PATENT DOCUMENTS 8,248,312 B2 * 8/2012 Guan ..... H01Q 1/243 343/702
2002/0163473 A1 11/2002 Koyama
2004/0100406 A1 * 5/2004 Okado ..... H01Q 1/38 343/700 MS
2005/0259029 A1 * 11/2005 O'Sullivan ..... H01Q 9/42 343/866
2006/0038721 A1 * 2/2006 Ozkar ..... H01Q 1/38 343/700 MS
2007/0018892 A1 * 1/2007 Ku ..... H01Q 1/2216 343/700 MS
2007/0069956 A1 * 3/2007 Ozkar ..... H01Q 5/00 343/700 MS
2009/0079639 A1 * 3/2009 Hotta ..... H01Q 1/243 343/702
2009/0160714 A1 * 6/2009 Qi ..... H01Q 1/243 343/702
2009/0219214 A1 * 9/2009 Oh ..... H01Q 1/528 343/702
2009/0262028 A1 * 10/2009 Mumbru ..... H01Q 5/371 343/702
2010/0007570 A1 * 1/2010 Sardariani ..... H01Q 1/2225 343/797
2010/0073241 A1 * 3/2010 Ayala Vazquez .... H01Q 1/2266 343/702
2010/0289709 A1 * 11/2010 Guan ..... H01Q 1/36 343/702
2011/0095949 A1 * 4/2011 Wong ..... H01Q 1/243 343/702
2011/0105062 A1 * 5/2011 Ridgeway ..... H01Q 1/38 455/129
2011/0156964 A1 * 6/2011 Lin ..... H01Q 1/243 343/702
2011/0187608 A1 * 8/2011 Byun ..... H01Q 1/244 343/702
2011/0227804 A1 * 9/2011 Nilsson ..... H01Q 9/28 343/840
2011/0316751 A1 * 12/2011 Jarvis ..... H01Q 1/243 343/702
2012/0098709 A1 * 4/2012 Chun ..... H01Q 1/243 343/702
2012/0154222 A1 * 6/2012 Oh ..... H01Q 1/243 343/702
2012/0154223 A1 * 6/2012 Oh ..... H01Q 1/243 343/702
2012/0229350 A1 * 9/2012 Chiang ..... H01Q 1/2266 343/702
2012/0242548 A1 * 9/2012 Badaruzzaman ..... H01Q 13/16 343/702
2012/0262347 A1 * 10/2012 Tiang ..... H01Q 1/243 343/702
2012/0293378 A1 * 11/2012 von Arbin ..... H01Q 1/243 343/702
2012/0313827 A1 * 12/2012 Kim ..... H01Q 1/243 343/702
2013/0076574 A1 * 3/2013 Rappoport ..... H01Q 1/243 343/702
2014/0071014 A1 * 3/2014 Tai ..... H01Q 1/243 343/848
2014/0085159 A1 * 3/2014 Wong ..... H01Q 5/328 343/843
2014/0253393 A1 * 9/2014 Nissinen ..... H01Q 1/36 343/702
2014/0333487 A1 * 11/2014 Tsai ..... H01Q 1/243 343/702
2014/0333488 A1 * 11/2014 Wang ..... H01Q 1/243 343/702

* cited by examiner

ANTENNA WITH THE EIGHTH OF THE WAVELENGTH

RELATED APPLICATIONS

This application claims priority to Taiwanese Application Serial Number 102136603, filed Oct. 9, 2013, which is herein incorporated by reference.

BACKGROUND

Field of Invention

The present invention relates to an antenna. More particularly, the present invention relates to an antenna with the eighth of the wavelength.

Description of Related Art

A space available to an antenna and the wavelength of the antenna are mutually related. With the limitation of the space, the antenna is designed to fit into the limited space. In general, the antenna is designed as the one with a quarter wavelength. The efficiency of the quarter wavelength antenna is better, and the distance of the wireless transmission can achieve over 200 meters (e.g., Wi-Fi). However, the space needed by the quarter wavelength antenna is relatively larger. Concerning the present compact electronic devices, it has been a challenge to arrange a space of accommodating the quarter wavelength antenna.

As far as the efficiency is concerned, the antenna now must be designed as the quarter wavelength, and the accommodation space therefore becomes a pressing challenge. Therefore, it is one of the important objectives to dispose an antenna with the one-eighth wavelength, under the condition of an interferential source of the antenna being controllable, so as to reduce the required accommodation space and operate the antenna under a working frequency.

SUMMARY

An antenna is provided to resolve the problems met in the art.

According to an embodiment of the present invention, the antenna includes a grounding conductor, a feed conductor, a resonant conductor, and a radiation conductor. The feed conductor is disposed apart from the grounding conductor, and one end of the feed conductor has a feed node configured to feed a signal. The resonant conductor has a resonant width, is disposed along the grounding conductor and disposed apart from the grounding conductor by a resonant-ground distance. One end of the resonant conductor is connected to another end of the feed conductor opposite to the feed node. The radiation conductor has a radiation width. One end of the radiation conductor is connected to the one end of the resonant conductor connected to the feed conductor, and another end of the radiation conductor is disposed apart from the grounding conductor. The radiation conductor comprises a deformable section and a plurality of extension sections extended from two opposing sides of the deformable section, and the plurality of extension sections are disposed along the resonant conductor and disposed apart from the resonant conductor by a resonant-radiation distance. The resonant conductor is positioned between the radiation conductor and the grounding conductor. A proportion of the resonant-ground distance, the resonant width, the resonant-radiation distance, and the radiation width is a fixed proportion.

In an embodiment, the grounding conductor has a slot, and the end of the feed conductor with the feed node is disposed toward the slot.

In an embodiment, the feed conductor is an elongated element.

In an embodiment, the grounding conductor comprises a protrusive part.

In an embodiment, the resonant conductor comprises at least one resonant bending part so that the resonant conductor is bent along the protrusive part and disposed apart from the protrusive part by the resonant-ground distance.

In an embodiment, the plurality of extension sections includes at least one radiation bending part so that the extension section is bent along the resonant conductor and disposed apart from the resonant conductor by the resonant-radiation distance.

In an embodiment, the proportion of the resonant-ground distance, the resonant width, the resonant-radiation distance, and the radiation width is 1:1:1:1.

In an embodiment, each of the resonant-ground distance and the resonant-radiation distance is 1 mm, and each of the resonant width and the radiation width is 1 mm.

In an embodiment, a range of an utility frequency of the antenna is 2.4 GHz-2.5 GHz.

In an embodiment, a total length of the resonant conductor and the radiation conductor connected together is an one-eighth wavelength related to the utility frequency of the antenna.

In an embodiment, a length of the resonant conductor is longer than an one-sixteenth wavelength related to the utility frequency of the antenna.

In an embodiment, the deformable section is a U-shaped element.

In summary, the technical solutions of the present invention have obvious advantages and beneficial effects over the prior art. With the above technical solutions, considerable advances of technology and extensive utilization in industry can be achieved. The present invention has an advantage in that disposing the antenna with the one-eighth wavelength to reduce the used space and make the antenna work on the utility frequency if the interferential source related to the antenna is controllable.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
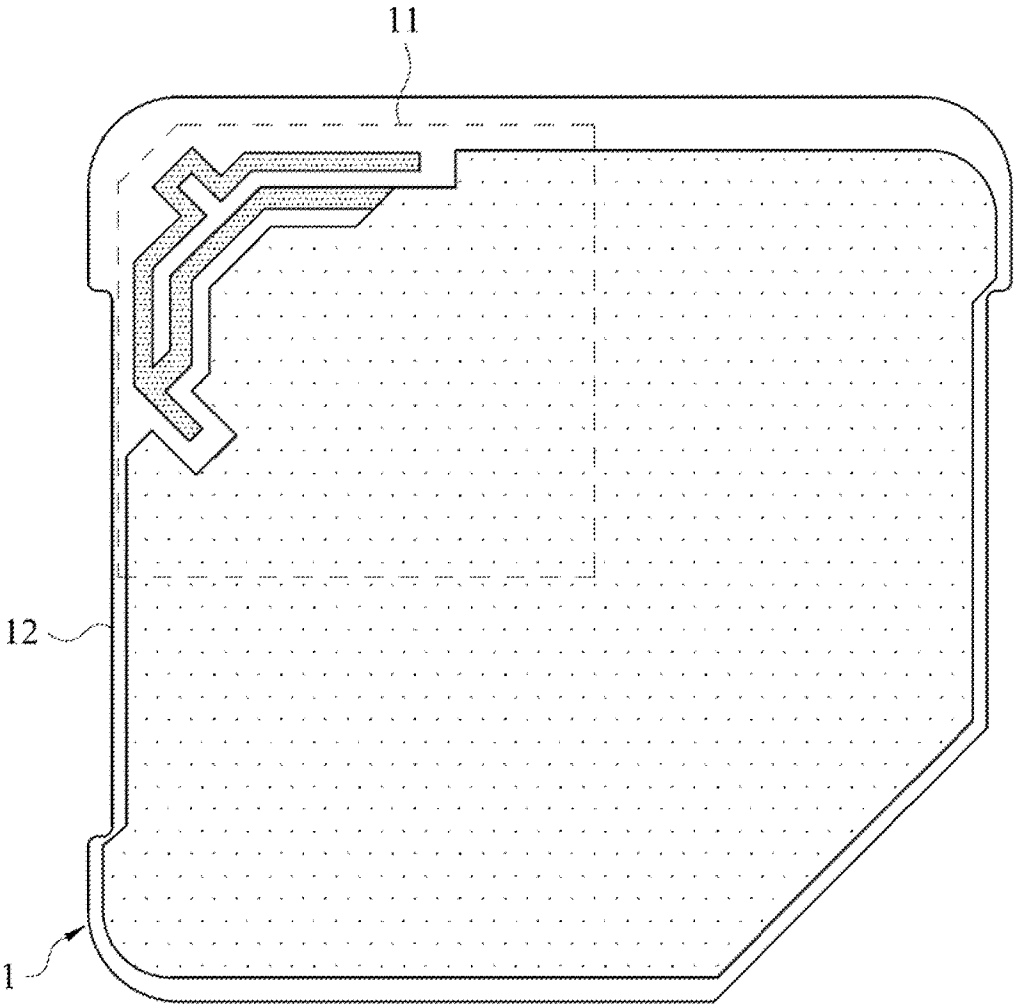
FIG. 1 is a schematic diagram of an antenna according to an embodiment of the present invention.

Reference will now be made in detail to the present embodiments of the invention, examples of which are illustrated in the accompanying drawings. Wherever possible, the same reference numbers are used in the drawings and the description to refer to the same or like parts. In addition, the well-known components and steps are not described in the embodiments to avoid unnecessary limitations to the present invention.

An antenna is used to transmit or receive the radio wave and electromagnetic wave, and it may be applied to the system such as the radio, the television, the wireless electronic device, the point-to-point radio communications device, the radar, the space exploration, etc. FIG. 1 is a schematic diagram of an antenna 11 according to an embodiment of the present invention. As shown in FIG. 1, a circuit board 1 is disposed on the wireless electronic device. For example, a wireless measuring instrument that is configured to measure the heartbeat of human transmits the result to a computer device with a bluetooth receiver module through the bluetooth transmission. The layout related to the circuit of the wireless electronic device is within the area of a circuit board edge 12 in the circuit board 1, and the antenna 11 that is configured to transmit the wireless signal may be disposed at a corner of the circuit board 1.

Figure 2:
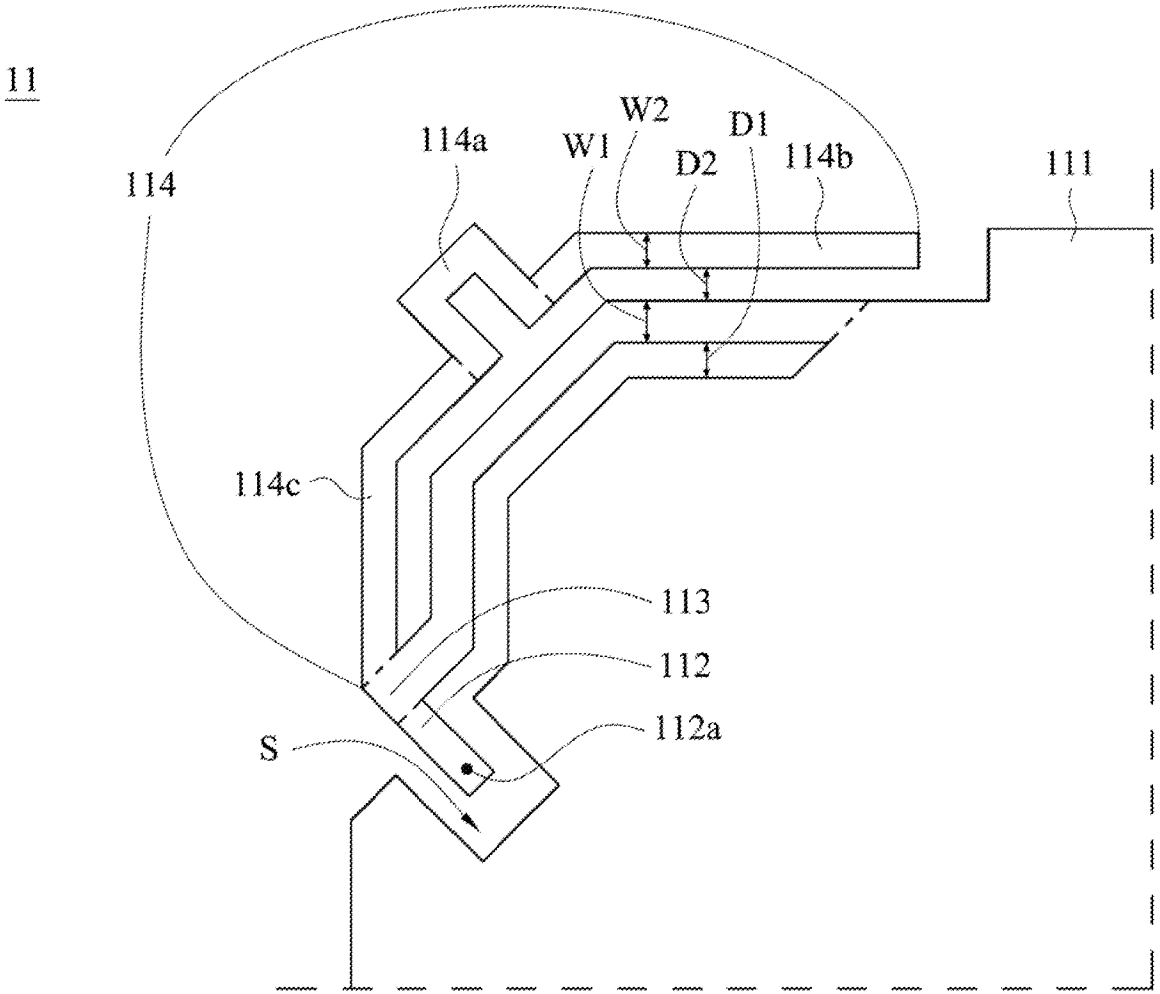
FIG. 2 is a structure diagram of an antenna according to an embodiment of the present invention.

FIG. 2 is a structure diagram of an antenna 11 according to an embodiment of the present invention. As shown in FIG. 2, in an embodiment, the antenna 11 of the present invention includes a grounding conductor 111, a feed conductor 112, a resonant conductor 113, and a radiation conductor 114. The grounding conductor 111 may be connected to a system ground terminal of the circuit board 1 through layout or via. The feed conductor 112 is disposed apart from the grounding conductor 111. One end of the feed conductor 112 has a feed node 112*a* that is configured to feed a signal. In a physical circuit, the feed node 112*a* is connected to a circuit module through a section of a micro wire and π circuit. A current of the circuit module will flow into the feed node 112*a* to cause the radiation conductor 114 of the antenna 11 generating the resonance radiation that is excited by the current. The current of the circuit module will also flow into the resonant conductor 113 from the feed conductor 112 through the feed node 112*a* then into the grounding conductor 111 and generate the resonance radiation on the grounding conductor 111. So the size or the shape of the grounding conductor 111 will influence the whole radiation pattern and the mode of the antenna. The position of the feed node 112*a* may be designed and further adjusted the impedance of the resonance point of the antenna 11 to meet a specified value (e.g., 50 Ohm) and thereby excite the radiation of the electromagnetic wave to transmit the signal due to the good impedance matching. The resonant conductor 113 has a resonant width W1, and it is disposed along the grounding conductor 111 and disposed apart from the grounding conductor 111 by a resonant-ground distance D1. One end of the resonant conductor 113 is connected to another end of the feed conductor 112 opposite to the feed node 112*a*.

The radiation conductor 14 has a radiation width W2. One end of the radiation conductor 114 is connected to the one end of the resonant conductor 113 that is connected to the feed conductor 112, i.e., one end of the feed conductor 112, one end of the resonant conductor 113, and one end of the radiation conductor 114 are connected together, and another end of the radiation conductor 114 is disposed apart from the grounding conductor 111. The radiation conductor 114 is resonated as an utility frequency (e.g., 2.4 GHz-2.5 GHz) to shoot or receive the electromagnetic signal. The radiation conductor 114 includes a deformable section 114*a* and extension sections 114*b*, 114*c* extended from two opposing sides of the deformable section 114*a*, and the extension sections 114*b*, 114*c* are disposed along the resonant conductor 113 and disposed apart from the resonant conductor 113 by a resonant-radiation distance D2. When the antenna 11 is disposed at the corner of the circuit board 1, the radiation conductor 114 is a part of the antenna 11 that is nearest to the circuit board edge 12. In order to achieve the more radiation effect on the radiation conductor 114, the deformable section 114*a* of the radiation conductor 114 may be changed its shape based on the size of the layout space, but its width is still kept the radiation width W2. For example, the deformable section 114*a* is a U-shaped element, and the closed end of the U-shaped element is toward the circuit board edge 12 to cause the deformable section 114*a* extended outward and strengthen the radiation effect. The resonant conductor 113 is positioned between the radiation conductor 114 and the grounding conductor 111, and a proportion of the resonant-ground distance D1, the resonant width W1, the resonant-radiation distance D2, and the radiation width W2 is a fixed proportion.

In an embodiment, the grounding conductor 111 has a slot S, the one end of the feed conductor 112 with the feed node 112*a* is disposed toward the slot S, and a part of the feed conductor 112 is disposed apart from the grounding conductor 111 inside the slot S. The position of the slot S should be adjusted based on the actual circuit layout. Those skilled in the art may specifically implement the slot S, feed conductor 112, and the feed node 112*a* with flexibility according to the requirements then.

In an embodiment, the feed conductor 112 is an elongated element. One end of the feed conductor 112 is connected to both the resonant conductor 113 and the radiation conductor 114, and another end of the feed conductor 112 is connected to the feed node 112*a*. It should be understood that the shape of the feed conductor 112 may not influence the radiation effect of the antenna 11, and the embodiment is not limit the scope of the invention. Those skilled in the art may specifically implement the feed conductor 112 with flexibility according to the requirements then.

Figure 3:
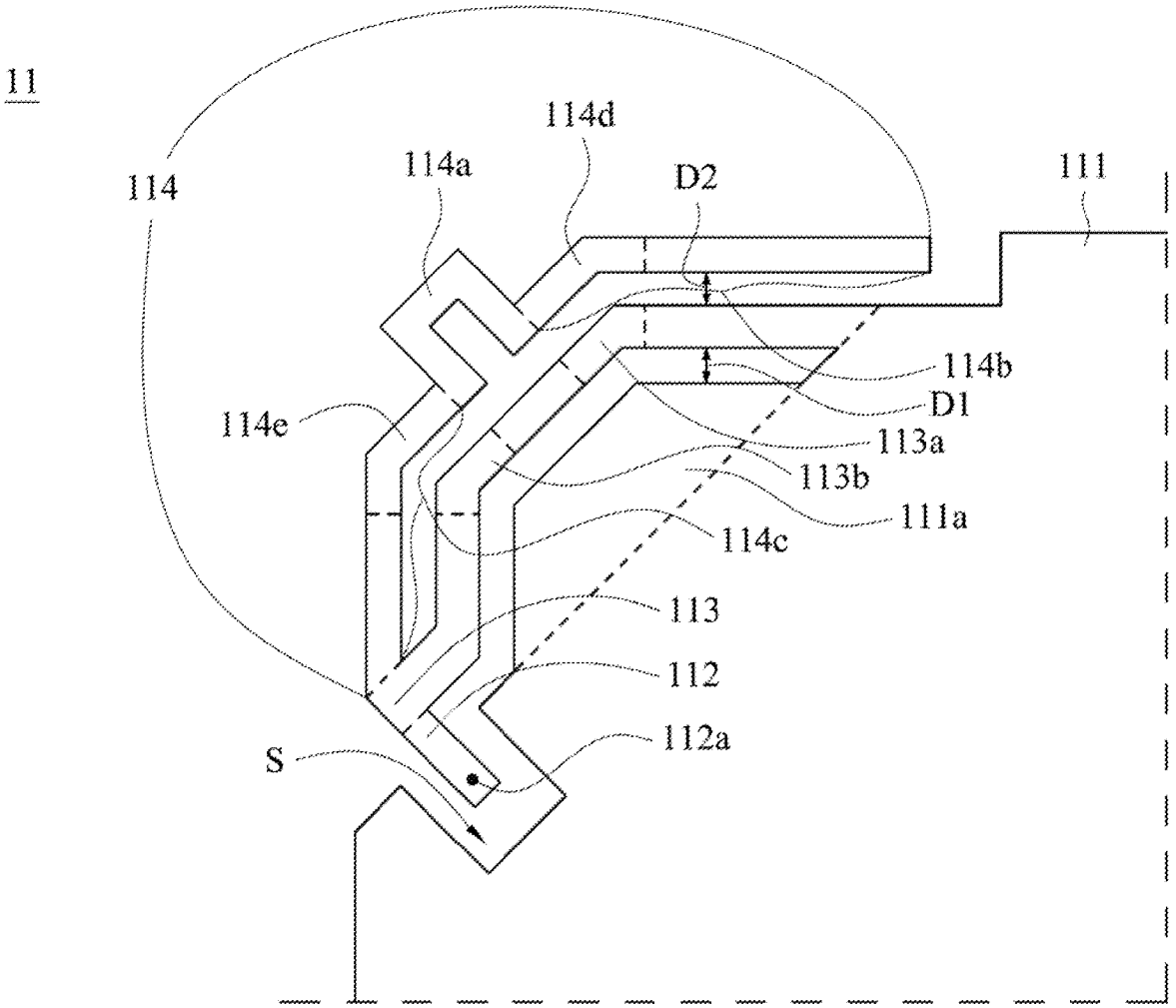
FIG. 3 is another structure diagram of an antenna according to an embodiment of the present invention.

FIG. 3 is another structure diagram of an antenna 11 according to an embodiment of the present invention. Because the size or the shape of the grounding conductor 111 may also influence the radiation pattern and the mode of the antenna, the edge of the grounding conductor 111 approached the resonant conductor 113 may be a line type or a protruded type. As shown in FIG. 3, in an embodiment, the grounding conductor 111 includes a protrusive part 111*a* that causes the edge of the grounding conductor 111 to protrude toward the resonant conductor 113. When the grounding conductor 111 includes the protrusive part 111*a*, the resonant conductor 113 must be disposed along the grounding conductor 111 and disposed apart from the grounding conductor 111 by the resonant-ground distance D1 so that the shape of the resonant conductor 113 is also changed due to the protrusive part 111*a*.

As shown in FIG. 2-FIG. 3, in an embodiment, the resonant conductor 113 includes resonant bending parts 113*a*, 113*b*. When the grounding conductor 111 includes the protrusive part 111*a*, the resonant bending parts 113*a*, 113*b* are configured to make the resonant conductor 113 bend along the protrusive part 111*a* and disposed apart from the protrusive part 111*a* by the resonant-ground distance D1 because the resonant conductor 113 must be disposed along the grounding conductor 111 and disposed apart from the grounding conductor 111 by the resonant-ground distance D1. It should be understood that the resonant bending parts 113*a*, 113*b* may be decided to dispose simultaneously or alternatively based on the shape of the protrusive part 111*a* because the shape of the protrusive part 111*a* may be depended on the circumstances. For example, when the protrusive part 111*a* protrudes only one angle, the resonant bending parts 113*a*, 113*b* exist alternatively. When the protrusive part 111*a* protrudes three angles, not only the resonant bending parts 113*a*, 113*b* is disposed simultaneously but also the other resonant bending parts is additionally disposed so that the resonant conductor 113 is bent and disposed apart from the protrusive part 111*a* by the resonant-ground distance D1. Furthermore, the position of the resonant bending parts 113*a*, 113*b* should be decided to disposed according to the shape of the protrusive part 111*a*.

In the same way, because the radiation conductor 114 must be disposed along the resonant conductor 113 and disposed apart from the resonant conductor 113 by the resonant-radiation distance D2, the shape of the radiation conductor 114 is also changed due to the resonant conductor 113 if the protrusive part 111*a* included in the grounding conductor 111 causes the shape of the resonant conductor 113 changing. In an embodiment, the plurality of the extension sections 114*c*, 114*b* include radiation bending parts 114*d*, 114*e* so that the extension sections 114*c*, 114*b* is bent along the resonant conductor 113 and disposed apart from the resonant conductor 113 by the resonant-radiation distance D2. It should be understood that the radiation bending parts 114*d*, 114*e* should be decided to dispose simultaneously, alternatively, or add the other radiation bending parts so that the radiation conductor 114 is bent and disposed apart from the resonant conductor 113 by the resonant radiation distance D2 because the shape of the protrusive part 111*a* will influence the shape of the resonant conductor 113 then influence the shape of the extension section 114*c*, 114*b*. Besides, the position of the radiation bending parts 114*d*, 114*e* should be decided to dispose according to the shape of the resonant conductor 113.

As shown in FIG. 2, in an embodiment, the proportion of the resonant-ground distance D1, the resonant width W1, the resonant-radiation distance D2, and the radiation width W2 is 1:1:1:1, i.e., each of the resonant-ground distance D1, the resonant width W1, the resonant-radiation distance D2, and the radiation width W2 is the same measured value. The proportion disclosed in this embodiment of the resonant-ground distance D1, the resonant width W1, the resonant-radiation distance D2, and the radiation width W2 is the best proportion gotten from the physical circuit after experimental testing. In an embodiment, each of the resonant-ground distance D1 and the resonant-radiation distance D2 is 1 mm, and each of the resonant width W1 and the radiation width W2 is 1 mm. It should be understood that none of the above examples is more preferable than any of the other examples, nor are they intended to limit the scope of the invention. Those skilled in the art may specifically implement the resonant-ground distance D1, the resonant width W1, the resonant-radiation distance D2, and the radiation width W2 with flexibility according to the requirements then, however the proportion of the resonant-ground distance D1, the resonant width W1, the resonant-radiation distance D2, and the radiation width W2 must be 1:1:1:1.

Figure 4:
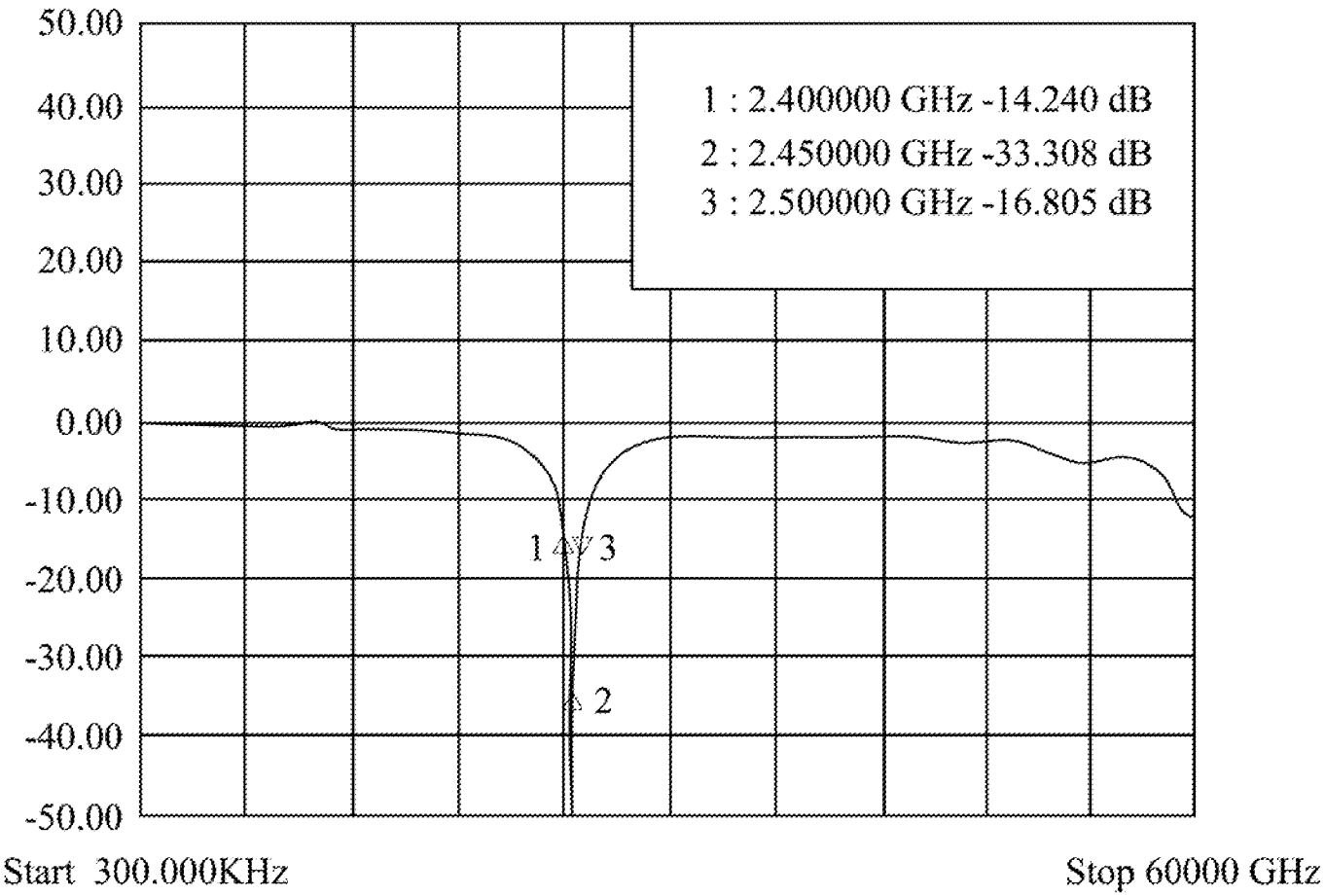
FIG. 4 is a return loss diagram of an antenna according to an embodiment of the present invention.

The antenna 11 as shown in FIG. 2-FIG. 3 is measured through a network analyzer. Each of the feed node 112*a* and the grounding conductor 111 is connected by coaxial cables to transmit the signal to the network analyzer, and a return loss of the antenna 11 that is called S11 can be known. The return loss S11 is a parameter elated to the reflection returned to the transmission signal terminal after the transmission signal terminal transmits the signal. It is better that the value of the return loss S11 is lower (e.g. −25 dB--40 dB), and it means the reflection fewer; the return loss S11 is called Input Reflection Coefficient. FIG. 4 is a return loss diagram of an antenna according to an embodiment of the present invention. As shown in FIG. 4, in an embodiment, a range of the utility frequency of the antenna is 2.4 GHz-2.5 GHz.

Figure 5A:
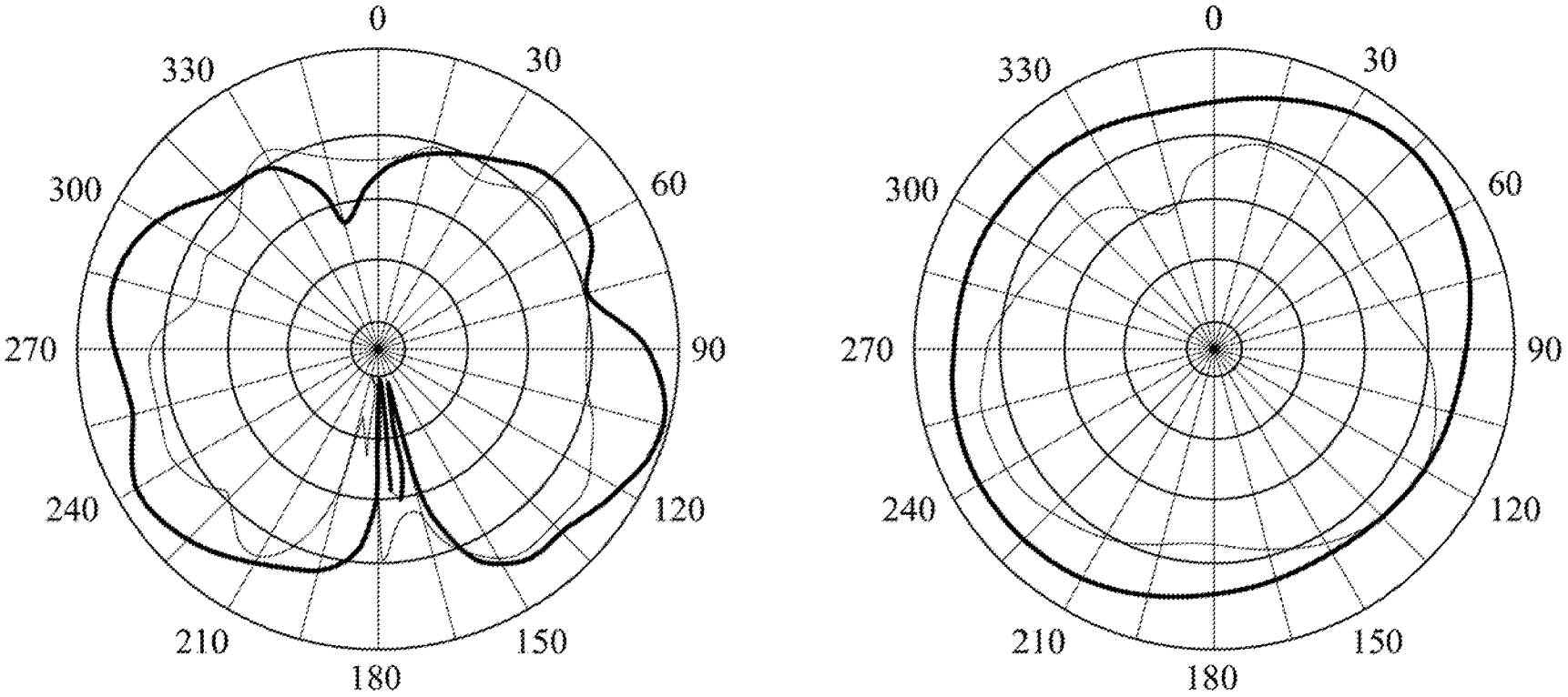
FIG. 5A-5C are radiation pattern diagrams of an antenna according to an embodiment of the present invention.
Figure 5B:
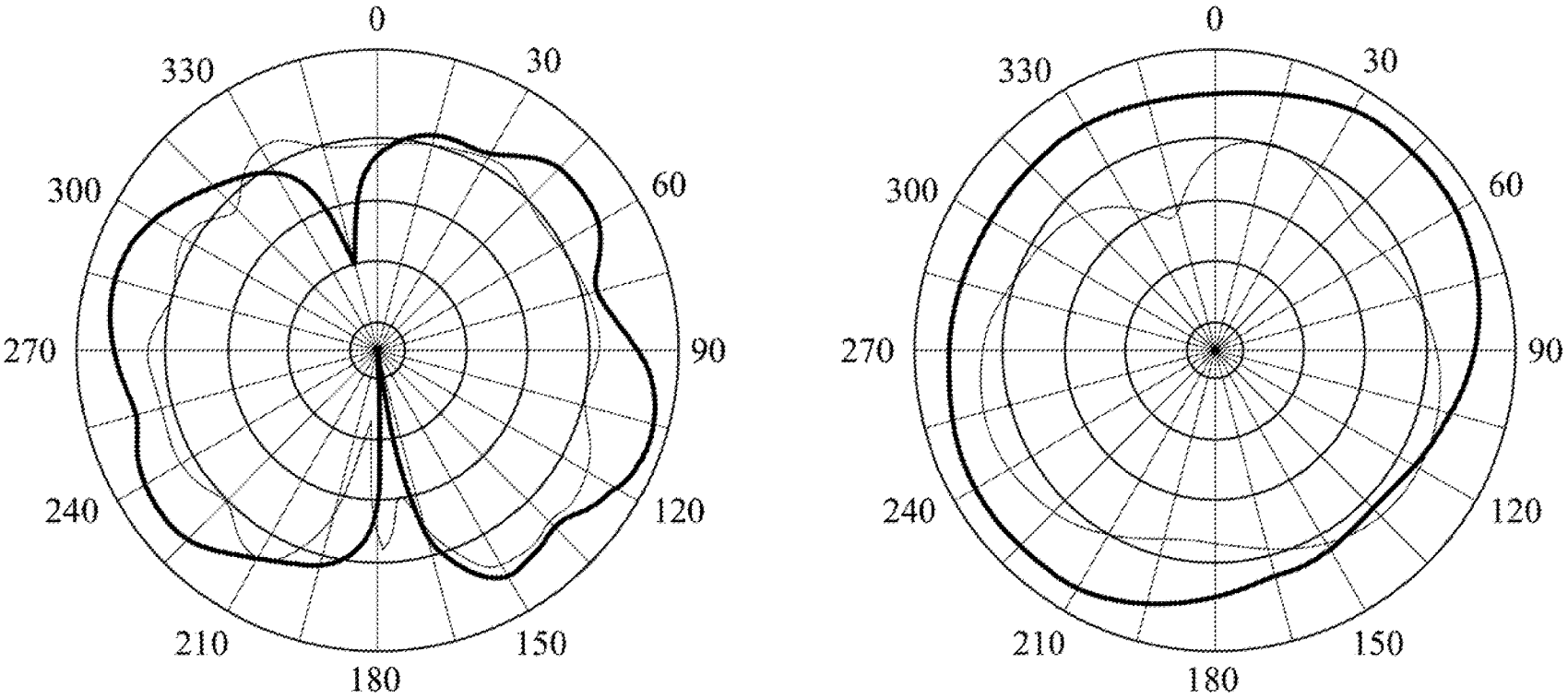
Figure 5C:
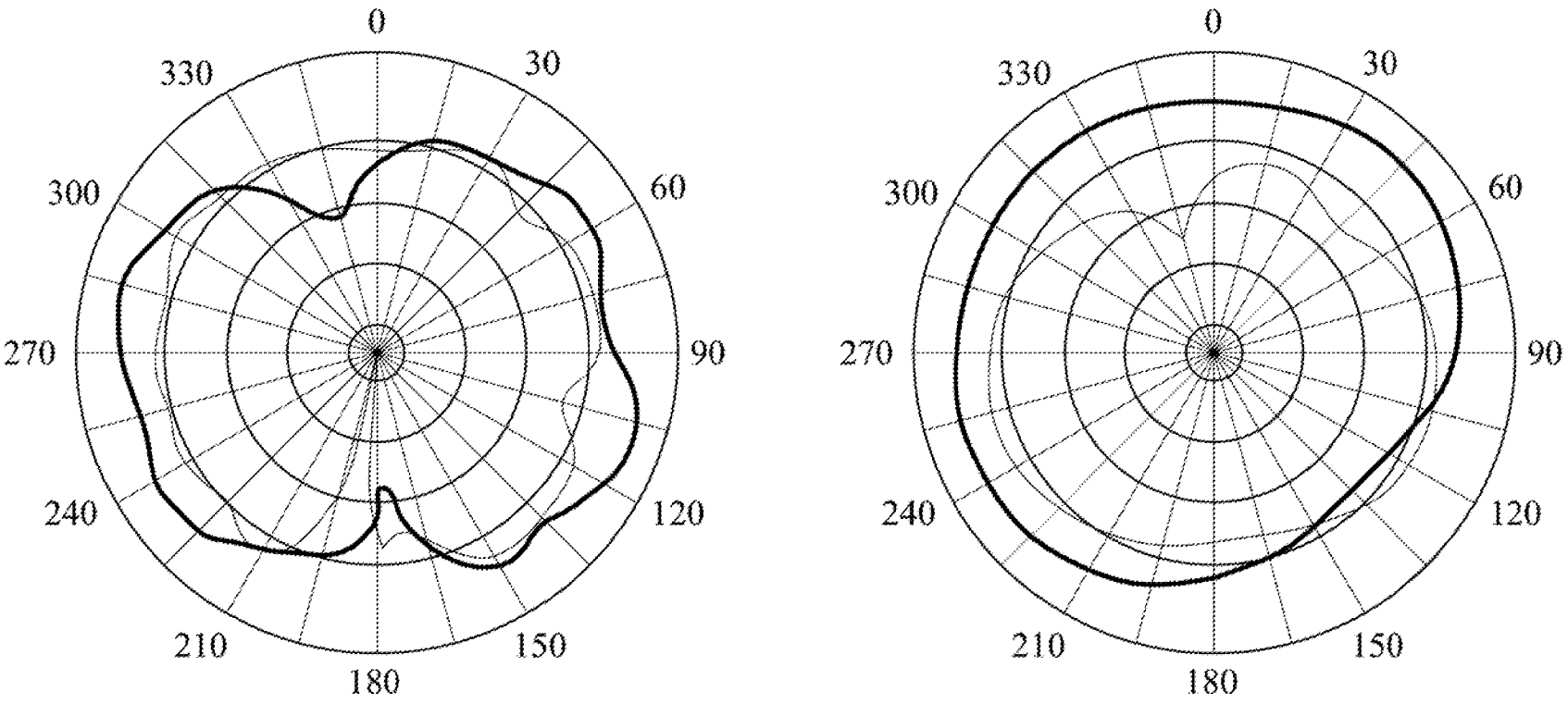

FIG. 5A-5C are radiation pattern diagrams of an antenna according to the embodiment of the present invention. FIG. 5A is a radiation pattern diagram when the utility frequency of the antenna is 2.4 GHz. FIG. 5B is a radiation pattern diagram when the utility frequency of the antenna is 2.45 GHz. FIG. 5C is a radiation pattern diagram when the utility frequency of the antenna is 2.5 GHz. According to the specific three dimensions (e.g., horizontal, vertical) plane, the antenna can be classified as two types. The first type is omni-directional antenna, and its characteristic is homogeneous radiation in the plane. The second type is directional antenna, and it has greater radiation intensity in specific plane. A radiation pattern diagram may describe the relative electric field intensity related to the antenna shooting or receiving. Because the antenna radiates to three dimensions, the radiation of the antenna needs a plurality of radiation pattern diagrams to describe. In the past, the designer of the antenna designed the antenna based on a quarter wavelength commonly. The antenna with the quarter wavelength is belong to the directional antenna that has greater radiation intensity in specific plane, so the radiation pattern diagram of the antenna with the quarter wavelength is directional. As shown in FIG. 5A-5C, the antenna disclosed in the present invention is an antenna with the one-eighth wavelength, and it is belong to the omni-directional antenna because the radiation pattern diagram is homogeneous radiation in the plane.

In the small area space, it is a good design method to use the antenna with the one-eighth wavelength if an interferential source is controllable; wherein the interferential source may be a radiation interference caused by the grounding conductor 111 (drawn in FIG. 2) connected to the antenna or caused by an electronic device with the antenna when humans use. It should be understood that the method for controlling the interferential source could be considered by the designer skilled in the art according to the requirements. As shown in FIG. 2, the application of the antenna 11 may achieved through the total length and each length of the two structure bodies (i.e., the resonant conductor 113, the radiation conductor 114). In an embodiment, if the antenna 11 is applied to wifi or bluetooth and acted on the utility frequency 2.4 GHz-2.5 GHz, the one-eighth wavelength is about 15 mm. Because the antenna with the one-eighth wavelength can be disposed in the narrow space, the radiation conductor 114 must be extended as the direction that is parallel with the resonant conductor 113 to make the radiation conductor 114 achieve the radiation function efficiently.

In an embodiment, the range of the utility frequency of the antenna 11 may be 2.4 GHz-2.5 GHz if the total length of the connection with the resonant conductor 113 and the radiation conductor 114 together. Because the design of the planar inverted F antenna (PIFA) structure must be effectively achieved the oscillated radiation of the utility frequency within the resonant area that is also the active point for the radiation efficiency, the length of the resonant conductor 113 is longer than an one-sixteenth wavelength related to the utility frequency 2.4 GHz-2.5 GHz of the antenna 11, i.e., 8-9 mm.

Figure 6:
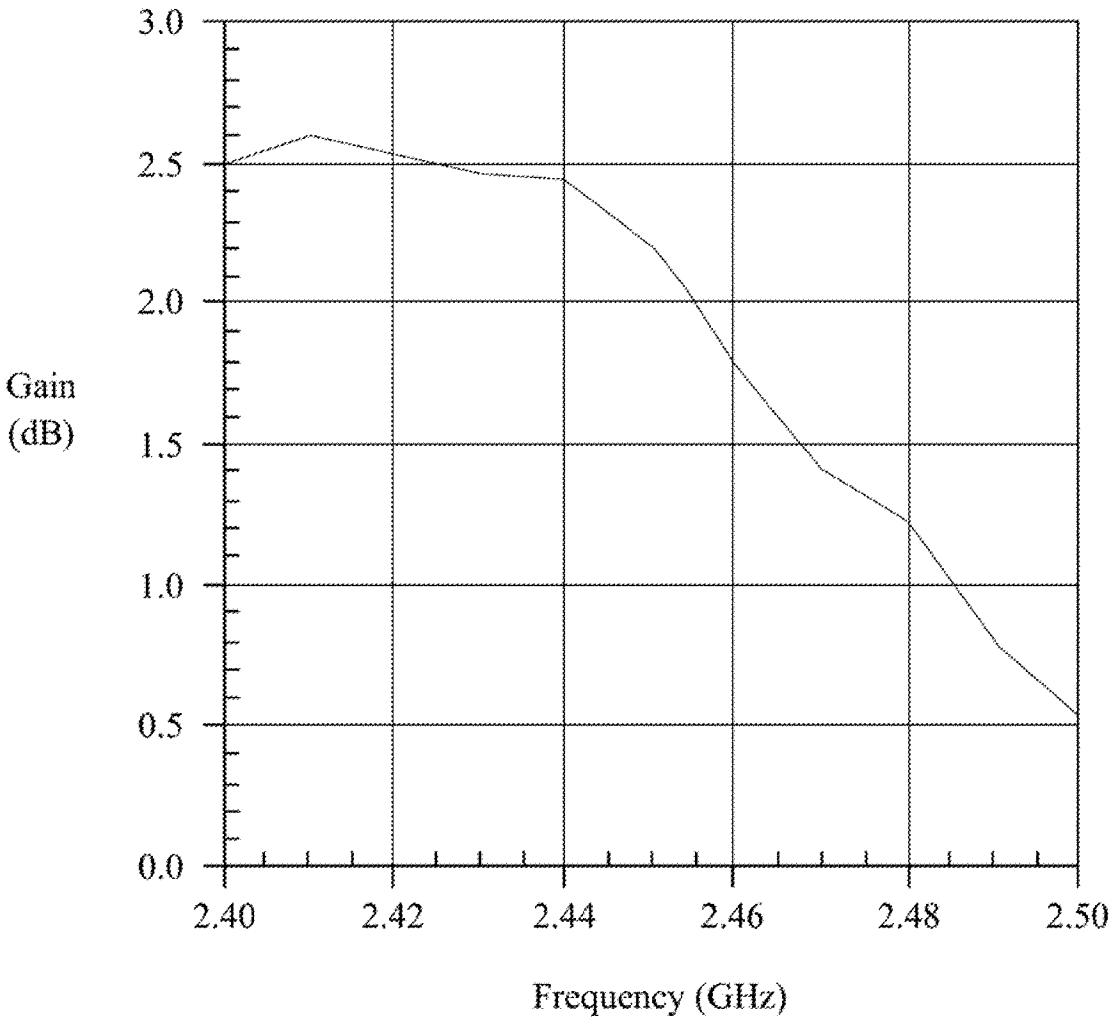
FIG. 6 is a maximum gain curve diagram of an antenna according to an embodiment of the present invention.
Figure 7:
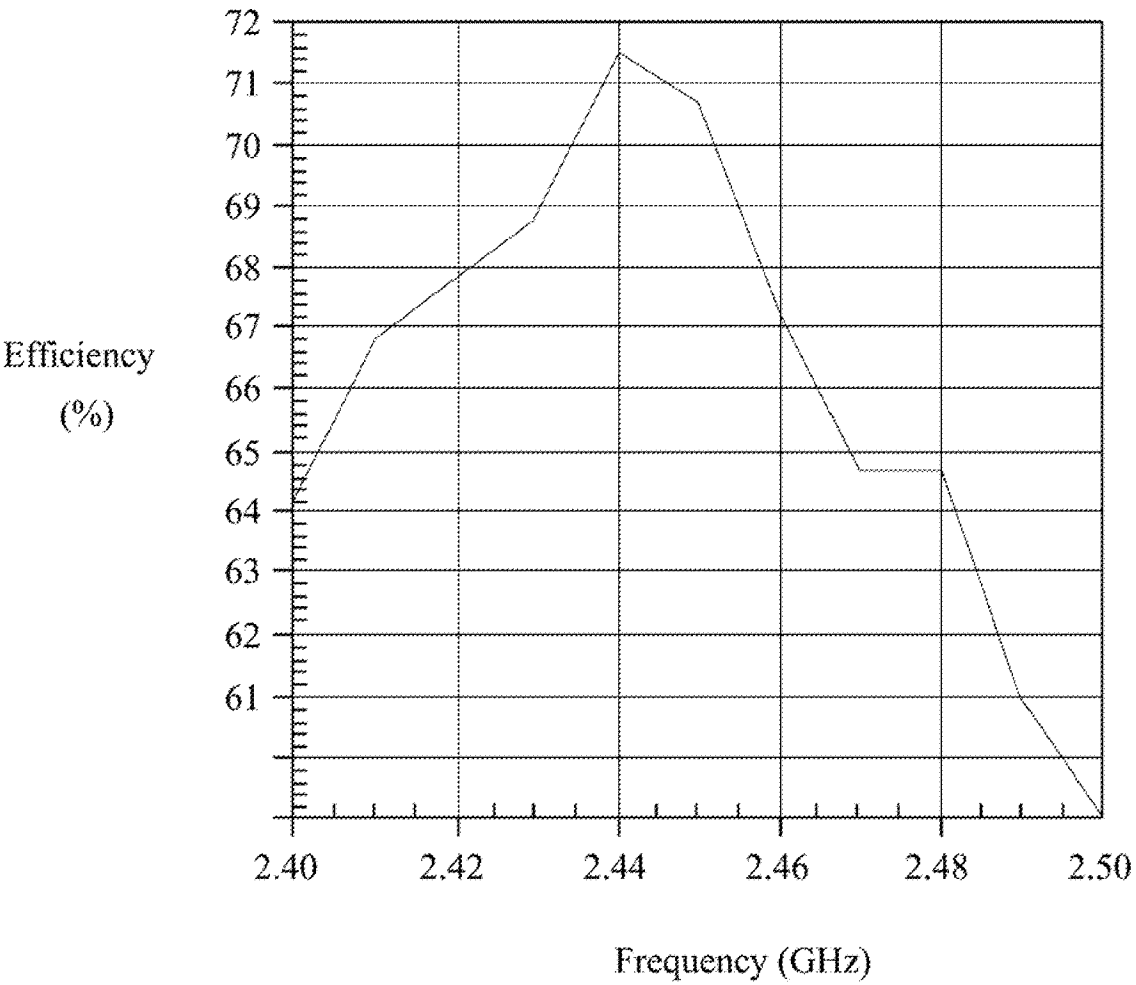
FIG. 7 is an efficiency diagram of an antenna according to an embodiment of the present invention.

FIG. 6 is a maximum gain curve diagram of an antenna according to an embodiment of the present invention. FIG. 7 is an efficiency diagram of an antenna according to an embodiment of the present invention. As shown in FIG. 6 and FIG. 7, the antenna 11 has good gain and radiation efficiency in a frequency band related to the utility frequency 2.4 GHz-2.5 GHz of the antenna 11.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna, comprising:

a grounding conductor;

a feed conductor disposed apart from the grounding conductor, and one end of the feed conductor having a feed node configured to feed a signal;

a resonant conductor having a resonant width, disposed along the grounding conductor and disposed apart from the grounding conductor by a resonant-ground distance, wherein one end of the resonant conductor is connected to another end of the feed conductor opposite to the feed node, and another end of the resonant conductor is connected to the grounding conductor; and a radiation conductor having a radiation width, one end of the radiation conductor connected to the one end of the resonant conductor connected to the feed conductor, and another end of the radiation conductor disposed apart from the grounding conductor, wherein the radiation conductor comprises only one deformable section and a plurality of extension sections extended from two opposing sides of the deformable section, and the deformable section is a U-shaped element with a closed end that extends away from the resonant conductor to cause the deformable section to extend outwardly, and the plurality of extension sections are disposed along the resonant conductor and disposed apart from the resonant conductor by a resonant-radiation distance, wherein the resonant conductor is positioned between the radiation conductor and the grounding conductor, and a proportion of the resonant-ground distance, the resonant width, the resonant-radiation distance, and the radiation width is a fixed proportion, and wherein the grounding conductor has a slot, and one end of the feed conductor with the feed node is disposed toward the slot on an opposite side leading to the grounding conductor, and a central line of the feed conductor is overlapped with a central line of the slot, and wherein the proportion of the resonant-ground distance the resonant width, the resonant-radiation distance, and the radiation width is 1:1:1:1, and wherein the grounding conductor comprises a protrusive part, the resonant conductor comprises at least one resonant bending part so that the resonant conductor is bent along the protrusive part and disposed apart from the protrusive part by the resonant-ground distance.

2. The antenna of claim 1, wherein the feed conductor is an elongated element.

3. The antenna of claim 2, wherein the plurality of extension sections comprises at least one radiation bending part so that the extension section is bent along the resonant conductor and disposed apart from the resonant conductor by the resonant-radiation distance.

4. The antenna of claim 1, wherein the plurality of extension sections comprises at least one radiation bending part so that the resonant conductor is bent along the extension section and disposed apart from the extension section by the resonant-radiation distance.

5. The antenna of claim 1, wherein each of the resonant-ground distance and the resonant-radiation distance is 1 mm, and each of the resonant width and the radiation width is 1 mm.

6. The antenna of claim 1, wherein a range of an utility frequency of the antenna is from 2.4 GHz to 2.5 GHz.

7. The antenna of claim 6, wherein a total length of the resonant conductor and the radiation conductor connected together is an one-eighth wavelength related to the utility frequency of the antenna.

8. The antenna of claim 7, wherein a length of the resonant conductor is longer than an one-sixteenth wavelength related to the utility frequency of the antenna.

9. An antenna disposed on a circuit board of an electronic device, the circuit board comprising an edge, a portion of the edge of the circuit board forming a corner of the circuit board, wherein the antenna comprises:

a grounding conductor;

a feed conductor disposed apart from the grounding conductor, and one end of the feed conductor having a feed node configured to feed a signal;

a resonant conductor having a resonant width, disposed along the grounding conductor and disposed apart from the grounding conductor by a resonant-ground distance, wherein one end of the resonant conductor is connected to another end of the feed conductor opposite to the feed node, and another end of the resonant conductor is connected to the grounding conductor; and a radiation conductor having a radiation width, one end of the radiation conductor connected to the one end of the resonant conductor connected to the feed conductor, and another end of the radiation conductor disposed apart from the grounding conductor, wherein the radiation conductor comprises a deformable section and a plurality of extension sections extended from two opposing sides of the deformable section, and the deformable section is U-shaped with a closed end that extends away from the resonant conductor to cause the deformable section to extend outwardly, and the plurality of extension sections are disposed along the resonant conductor and disposed apart from the resonant conductor by a resonant-radiation distance, and wherein the resonant conductor is positioned between the radiation conductor and the grounding conductor, and a proportion of the resonant-ground distance, the resonant width, the resonant-radiation distance, and the radiation width is a fixed proportion; and wherein the radiation conductor, the resonant conductor, and the feed conductor are positioned at the corner of the circuit board, the deformable section of the radiation conductor is disposed between the corner of the circuit board and the resonant conductor, and the closed end of the deformable section of the radiation conductor extends away from the resonant conductor and toward the corner of the circuit board.

10. The antenna of claim 9, wherein a line that extends through a center of the deformable section of the radiation conductor in the extension direction of the deformable section passes through said corner of the circuit board at which the radiation conductor, the resonant conductor, and the feed conductor are positioned.

11. The antenna of claim 9, wherein the proportion of the resonant-ground distance, the resonant width, the resonant-radiation distance, and the radiation width is 1:1:1:1.

12. The antenna of claim 9, wherein the grounding conductor has a slot, and one end of the feed conductor with the feed node is disposed toward the slot on an opposite side leading to the grounding conductor, and a central line of the feed conductor is overlapped with a central line of the slot.

* * * * *